United States Patent [19]

Beaver et al.

[11] Patent Number: 4,860,648

[45] Date of Patent: Aug. 29, 1989

[54] PRINTING APPARATUS FOR MARKING INDICIA ON ARTICLES BEING SUCCESSIVELY CONVEYED

[75] Inventors: Robert A. Beaver, Fort Wayne; Leonard L. Johnson, Huntertown; Lester R. Medlen, Fort Wayne, all of Ind.

[73] Assignee: Lincoln Logotype Company, Inc., Fort Wayne, Ind.

[21] Appl. No.: 198,113

[22] Filed: May 24, 1988

[51] Int. Cl.[4] ..... B41F 17/26

[52] U.S. Cl. ..... 101/35; 101/330

[58] Field of Search ..... 101/35, 329, 330, 331, 101/349, 350

[56] References Cited

U.S. PATENT DOCUMENTS

| | | | |
|---|---|---|---|
| 2,829,589 | 4/1958 | Alessi, Jr. et al. | 101/35 |
| 3,327,624 | 6/1967 | Beaver | 101/35 |
| 3,457,854 | 7/1969 | Marozzi | 101/35 |
| 3,467,008 | 9/1969 | Domotor | 101/350 X |
| 3,647,525 | 3/1972 | Dahlgren | 101/350 X |
| 3,786,746 | 1/1974 | Roberts | 101/35 |

*Primary Examiner*—Clifford D. Crowder

*Attorney, Agent, or Firm*—Pearne, Gordon, McCoy & Granger

[57] ABSTRACT

A marking apparatus for printing indicia on products being transported along a conveyor. The moving products, such as cartons, are engaged by a printing roll with a drive rim that engages the surface of the article. As the printing roll turns, a printing segment carried on the roll comes into contact with the surface to print the indicia thereon. Ink is supplied to the printing segment by means of an ink supply roll mounted on a lever arm and which contains a supply of ink that is supplied to a porous ink-containing cylindrical surface. The lever arm is urged in one direction of rotation by a biasing device such as a compression spring to force the ink supply roll against an adjacent ink transfer roll with a predetermined force. The ink transfer roll has a cylindrical, elastomeric pad that receives ink from the ink supply roll and transfers it to the printing segment of the printing roll. A gear is connected between the printing roll and the transfer roll for turning the transfer roll surface at a speed differential relative to the surface speed of the marking surface so as to provide sliding contact between the ink transfer surface and the marking surface.

12 Claims, 4 Drawing Sheets

PRINTING APPARATUS FOR MARKING INDICIA ON ARTICLES BEING SUCCESSIVELY CONVEYED

BACKGROUND OF THE INVENTION

This invention relates to printing apparatus, and especially to roller type printing devices for applying various indicia to the surface of moving articles such as packages being successively conveyed. More particularly, the invention relates to an improved printing device for marking a surface by rolling an ink-carrying cylindrical printing segment against the surface to be marked.

In the manufacture and packaging of various goods, certain markings such as date codes, names, coded identifiers and the like are printed on the packages or products as they are being conveyed at a high rate of speed. Such packaging may be of metal, plastic or cardboard, for example, and in many instances the marking must be printed with considerable accuracy at a precise location on the rapidly moving surfaces. One type of marking for packages and products that has come into widespread use is optically readable characters such as scannable and verifiable bar codes. Bar codes comprise a series of parallel lines or bars of varying width and spacing, containing coded information that can be read by an optical device. These codes must be printed very accurately and without variation in the predetermined incremental dimensions. The printing machine must be capable of accurate marking regardless of variations in the shape, etc. of the surface to be marked.

Various printing devices and associated apparatus have been employed to make clear ink imprints at high speeds, certain of these being the subject of U.S. Pat. Nos. 3,071,071; 3,093,040; 3,122,993; 3,230,880; 3,327,624; 3,736,870; 3,968,747; 4,129,074; and 4,729,313.

The level of accuracy required in printing bar codes of sufficient sharpness and clarity to be read by an optical reader makes it extremely important that the application of ink to the typeface or marking pad of the printing roll be uniform and consistant. An insufficient application of ink to the type could result in an imprint that could not be accurately read by an optical reader and, conversely, and excess of ink could result in distortion that could likewise generate an inaccurate optical reading.

The apparatus of the present invention, however, resolves the difficulties indicated above and affords other features and advantages heretofore obtainable.

SUMMARY OF THE INVENTION

It is among the object of the invention to provide a marking apparatus that is capable of making accurate imprints on the surfaces of various articles as they are conveyed sequentially along a given path.

Another object is to provide a marking apparatus that is capable of making a uniform and consistent imprint over a long period of operation through numerous cycles.

Still another object is to provide a printing apparatus that has means for accurate and continuous application of ink to the typeface in such a way that a sharp and accurate print without flaws is made in each marking cycle.

These and other objects and advantages are achieved with the unique printing apparatus of the invention, which includes a mounting base adapted to be located adjacent a predetermined path or conveyor along with which products to be marked are conveyed at uniform speed. A printing roll is journaled on the base and has a drive rim adapted for rolling engagement with the appropriate surface of an article to be marked to turn the printing roll in response to the movement of the article. The printing roll also has a cylindrical marking pad or type segment adapted for rolling engagement with the moving surfaces to print the indicia thereon.

A lever arm is mounted at one end on the base for pivotal movement about a fixed axis and a resilient means is provided that bears between the lever arm and the base to urge the lever arm with a predetermined force in one direction of rotation toward an operating position. An ink supply roll is journaled on the other end of the lever arm, the supply roll having an ink reservoir and a porous, absorbent ink-containing cylindrical pad. An ink transfer roll is journaled on the base, and has an ink receptive elastomeric cylindrical transfer pad adapted for engagement with the ink supply roll and the marking face of the print roll to transfer ink from the supply roll to the marking pad.

A gear train is operatively connected between the printing roll shaft and the transfer roll shaft so that the ink transfer surface of the transfer roll is turned at a surface speed slightly different from the surface speed of the typeface of the printing roll to provide sliding contact between the ink transfer surface and the marking surface. The controlled sliding contact produces an accurate and uniform transfer of ink from the ink transfer roll to the typeface and also the predetermined force used to press the inking surface of the supply roll against the transfer roll produces a desirable and uniform level of transfer of ink to the transfer roll.

DESCRIPTION OF THE PREFERRED EMBODIMENT

Figure 1:
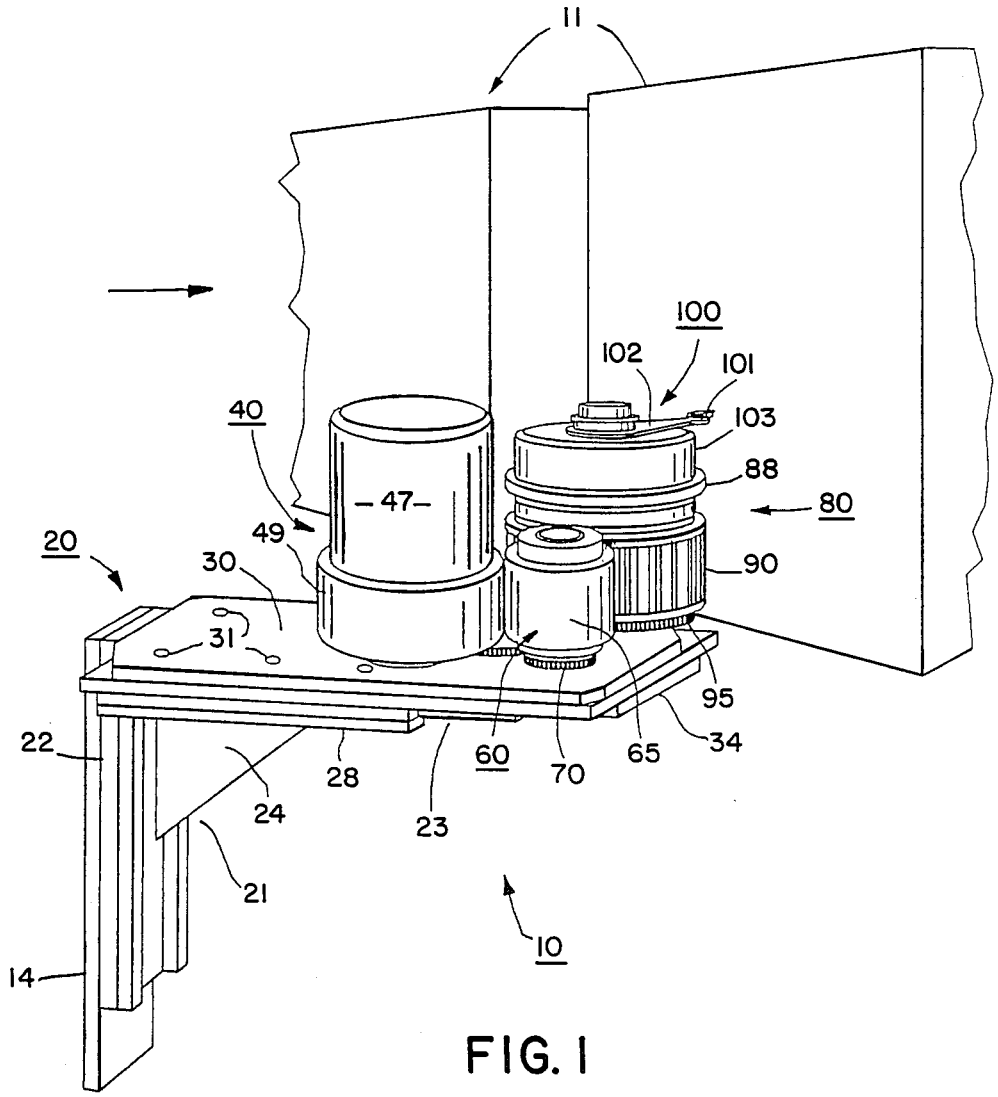
FIG. 1 is a perspective view showing a printing apparatus embodying the invention mounted to print indicia on a surface of moving cartons.
Figure 2:
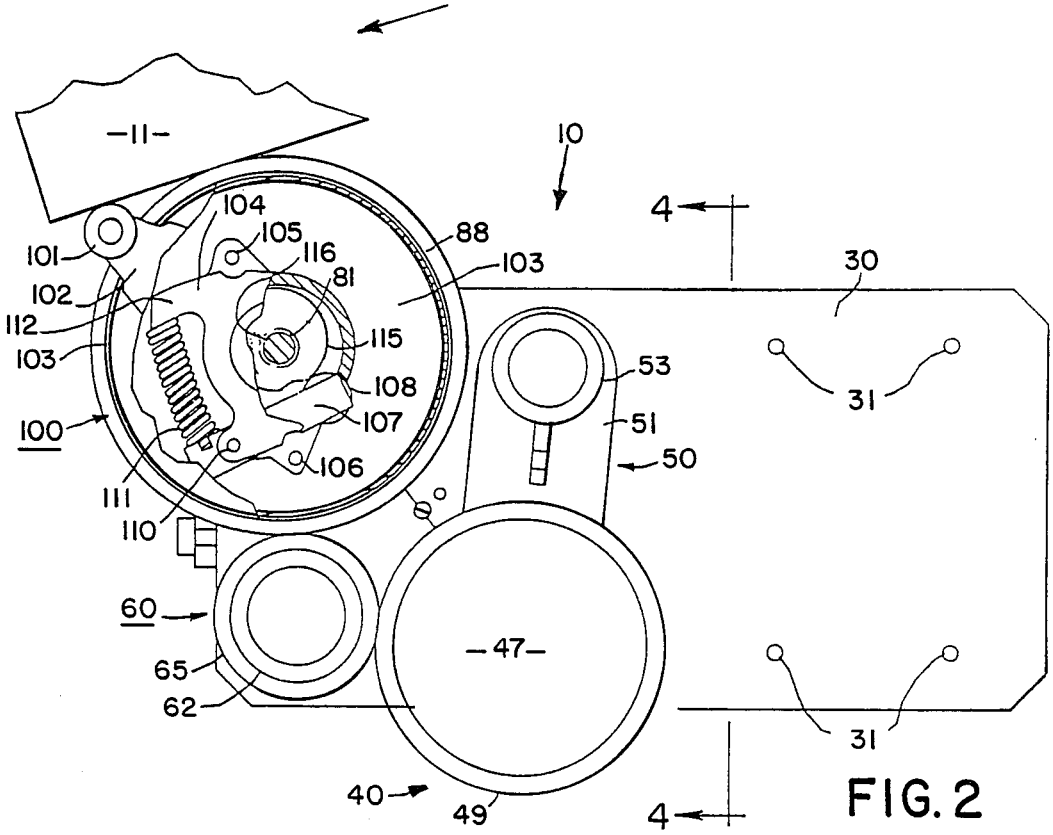
FIG. 2 is a plan view of the printing apparatus of FIG. 1, with part of the printing roll assembly broken away for the purpose of illustration.

Referring more particularly to the drawings, there is shown a printing machine 10 embodying the present invention and adapted to apply or mark a scannable code such as a bar code imprint on the surfaces of moving cartons being conveyed successively along a predetermined path, such as on a conveyor (not shown). A bar code is a type of indicia that is readable by an optical scanning device or the like. The printing machine 10 is mounted by a bracket 14 to suitable structure adjacent the conveyor (not shown).

The printer includes as its principle components a frame assembly 20, an ink roll assembly 40, an ink transfer roll assembly 60, and a printing roll assembly 80 with an associated indexing mechanism 100.

The frame assembly 20 includes an angle bracket 21 with a vertical leg 22 and a horizontal leg 23 braced with a web 24. The side edges of the horizontal leg 23 are shaped and machined to provide rails 25 and 26 to accommodate horizontal sliding movement thereon of a sub plate 27. The sub plate is secured to the horizontal leg 23 by claws 28 which serve to clamp the rails 25 and 26 between the respective claws and the sub plate. The claws are attached to the mounting plate by socket head cap screws 29.

A mounting plate 30 is secured to the sub plate 27 by cap screws 31. This arrangement permits horizontal adjustment of the mounting plate 30 and sub plate 27 in a linear path to position the printing roll assembly 80 in the proper position relative to the moving boxes 11. The outer end of the sub plate 27 is provided with a stop bar 34 which is secured to the end of the plate by socket head cap screws.

Ink Supply Roll Assembly

The ink supply roll assembly 40 includes a lever assembly 50 which is pivoted at one end on the plate 30 and which carries on its other end a vertical roll shaft 41. The assembly 40 includes an ink canister hub 42 supported for rotation on the shaft 41 and having a central bore that receives two bearings 43 and 44 retained in position by snap rings. An ink canister 47 of the type described in pending U.S. patent application No. 102,886 is mounted on the hub 43. That application is incorporated by reference herein and made a part hereof. The canister 49 includes an ink reservoir 48 and a porous cylindrical ink supply pad 49 that receives and absorbs ink from the reservoir 48 through its interior surface and maintains its outer surface wet with ink.

The ink supply pad 49 is most advantageously made from the microporous material described in U.S. Pat. No. 4,768,437, granted Sep. 6, 1988. That material is manufactured and sold by Porelon, Inc. of Cookville, Tenn.

The lever assembly 50 includes a lever arm 51 mounted for pivotal movement at the end opposite the canister 47, by means of a fixed shaft 52 that is secured on the mounting plate 30. The shaft 52 extends through a hub 53 on the respective end of the lever 51, the hub having a central bore with circumferential grooves that receive snap rings. The snap rings serve to retain two bearings 54 received on the shaft 52. Accordingly, the canister 47 is swung through an arc as the outer end of the lever 51 is pivoted around the fixed shaft.

Figure 3:
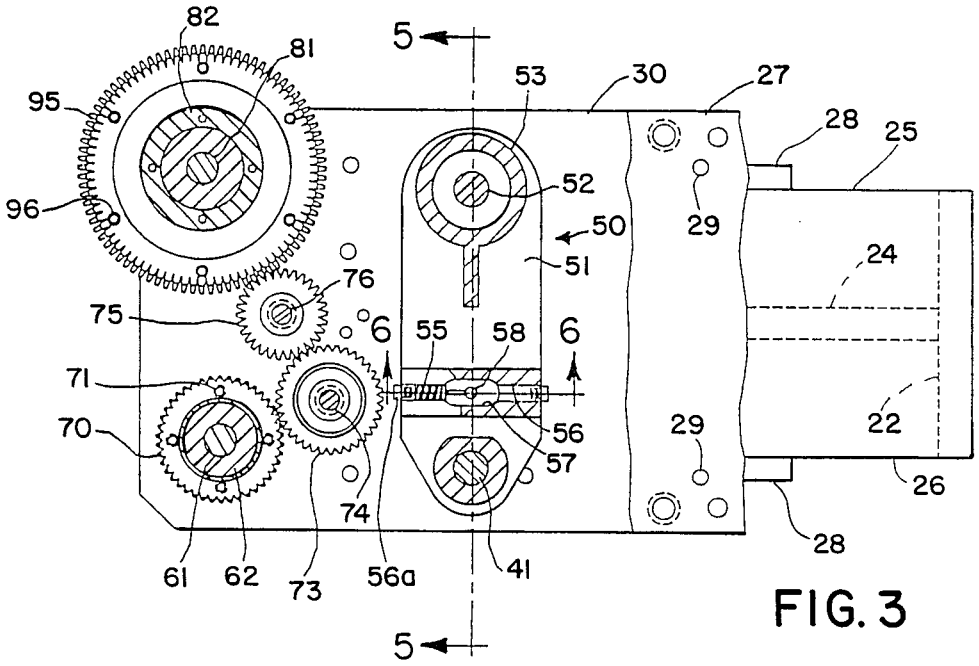
FIG. 3 is a sectional view of the printing apparatus of FIGS. 1 and 2 taken on the line 3—3 of FIG. 4 and with parts broken away for the purpose of illustration.
Figure 4:
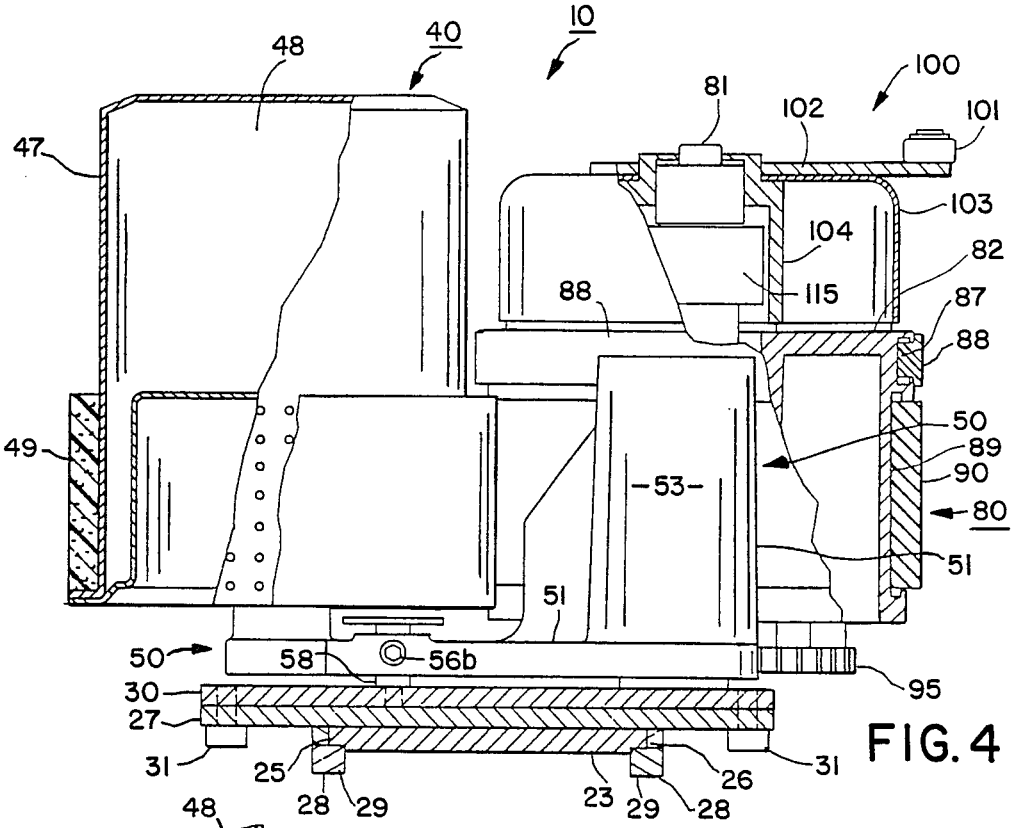
FIG. 4 is an elevational viw of the printing apparatus of FIGS. 1 through 3 taken on the line 4—4 of FIG. 2 and with parts broken away and shown in section for the purpose of illustration.
Figure 5:
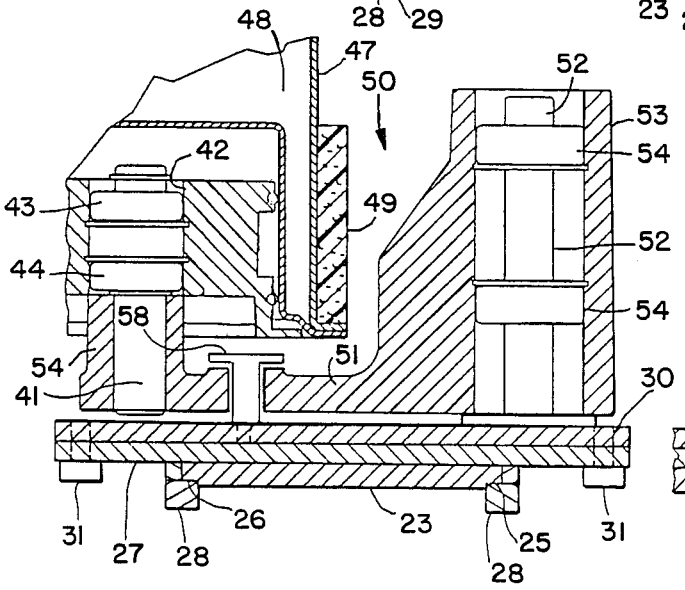
FIG. 5 is a fragmentary sectional view taken on the line 5—5 of FIG. 3.
Figure 6:
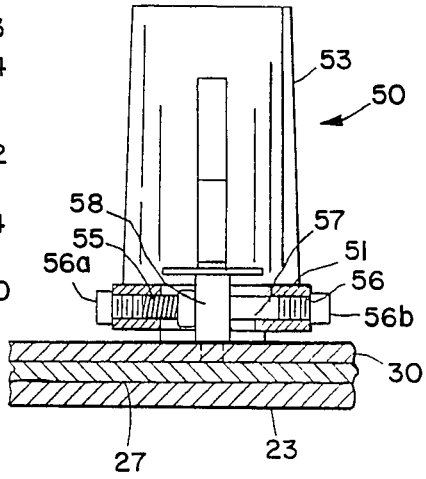
FIG. 6 is a fragmentary sectional view taken on the line 6—6 of FIG. 3.

The lever arm 51 is biased in one direction, namely, toward the ink transfer roll assembly 60, by means of a helical compression spring 55 (FIG. 3) located in a lateral bore 56 that extends horizontally through a central portion of the lever arm. A vertical slot 57 is cut through the lever arm 51 at a location that communicates with lateral bore 56 and a fixed stop element 58 mounted in the mounting plate 30 extends upwardly through the slot 57 so as to define limits of pivotal movement of the lever arm 51. The helical spring 55 is positioned around one end of a spring guide 58 which bears against the stop 59 and the other end of the spring engages a setscrew **56*a* threadedly received in the one end of the bore 56. The setscrew 56*a* may be turned to adjust the force exerted by the spring 55. The other end of the bore 56 also has a setscrew 56*b*** located therein.

Accordingly, the helical spring 55 is effective to urge the lever assembly in a direction causing the porous pad 49 of the ink canister 47 to be pressed against the ink transfer roll assembly 60 with a predetermined force per length unit of contact. The resulting force per unit length produces effective results when adjusted to between about 0.75 and 1.5 lbs. per inch, and preferably between 0.9 and 1.1 lbs. per inch.

Ink Transfer Roll Assembly

The ink transfer roll assembly 60 is supported on a fixed vertical shaft 61 mounted on the mounting plate 30. The assembly 60 includes a hub 62 with a central bore. The bore has circumferential grooves that receive snap rings. The snap rings support a pair of bearings (not shown) which engage the shaft 61. The hub 62 supports a cylindrical ink receptive elastomeric pad 65 which is formed of a material sufficiently flexible and porous to receive and retain a quantity of ink from the ink pad 49 and transfer the ink contained in the pad 65 to the type segment of the printing roll assembly 80.

A gear 70 is secured to the bottom of the hub 62 by means of socket head cap screws 71. The purpose of the gear 70 is to drive the pad 65 at a predetermined surface speed that is related to the speed of the printing roll assembly 80.

The gear 70 engages an idler gear 73 mounted on a fixed shaft 74 secured to the mounting plate 30. The gear 73 engages another idler gear 75 mounted on another fixed shaft 76 also secured to the mounting plate 30.

Printing Roll Assembly

The printing roll assembly 80 has an associated index mechanism 100 which is used to sense the approach of a carton or article to be marked and also to delay the application of indicia until the carton proceeds to a predetermined position. The assembly 80 includes a fixed shaft 81 secured to the mounting plate 27 and a hub 82 rotatably supported on the fixed shaft. The hub is rotatably supported on the fixed shaft 81 by means of two bearing assemblies. The upper end of the hub 82 has an annular channel 87 formed therein that receives an elastomeric drive rim 88. The drive rim 88 is adapted for rolling engagement with the surface of the carton or the like to be marked and to caues rotation of the ink roll assembly in response to the linear movement of the carton.

Immediately below the channel 87 is a larger annular channel 89 adapted to receive a cylindrical printing segment 90. The printing segment is initially formed as a flat strip that is placed in the channel in a cylindrical or annular form and clamped in place by means of a pair of type stops. The type stops serve to clamp the ends of the printing segment 90 by the tightening of a setscrew which forces the type stop against the edges of the printing segment.

The printing segment 90 may be, for example, formed in accordance with the printing segment described in U.S. Pat. No. 4,729,313.

An annular drive gear 95 is secured to the bottom of the hub 82 by mounting screws 96. The gear 95 engages the idler gear 75 so that the rotation of the printing roll assembly 80 caused by engagement of the drive rim 88 with the surface of carton 11 not only serves to turn the ink roll assembly but also causes simultaneous positive rotation of the ink transfer roll pad 65.

In accordance with the invention, however, the gear ratios are selected to produce a differential in the surface speeds of the ink transfer roll pad 65 and the typeface of the printing segment 90, the differential being between about 5% and 12%. This speed differential produces a wiping effect that improves the uniform transfer of ink from the ink transfer roll to the typeface. It has been determined that the ideal range for this differential is between plus or minus 5% and 12%, and preferably about 7.5%.

The index mechanism 100 is constructed according to and functions in the manner described in U.S. Pat. No. 3,327,624. The mechanism includes an index roller 101 mounted at the outer end of a carrier arm 102 which is secured at its inner end to an index cover 103. The index cover 103 and the arm cover 102 are secured to an index housing 104, which in turn is secured to the hub 82 by screws 105 and 106 that extend through mounting tabs on the housing 103. Accordingly, the index housing 104 turns with the hub 82 in response to the engagement between the surface of carton 11 and the drive rim 88.

The index housing 104 carries a cam lever 107 that in turn has a cam roller 108 at one end. The cam lever 107 is pivotally supported on the index housing 103 by a pivot pin 110.

The end of the lever opposite the cam roller 108 is engaged by helical spring 111 that bears between a fixed arm 112 of the index housing and the end of the lever to bias the lever in a direction tending to urge the cam roller radially inward.

The cam roller 108 engages an eccentric cam 115 that is fixed to the shaft 81 and which has a detent 116 formed at a predetermined location. The detent determines the neutral or initial position of the cam lever.

As a result of the force applied through the spring 111 to the cam roller 108 bearing against the cam 115, the index housing 104 is biased toward rotary movement either clockwise or counterclockwise, tending to return the cam roller to the detent 110. Thus whenever driving engagement between the drive rim 88 and the carton 11 is discontinued after a carton passes the printing roll assembly 80, the carrier arm 102 will be indexed back to a predetermined initial position.

Operation

The printing assembly thus described is adapted to supply ink from the canister 47 to the outer surface of the porous ink pad 49 from which the ink is transferred to the surface of the transfer pad 65. This occurs as a result of the controlled contact pressure between the ink roll pad 49 and the transfer roll pad 65. The pressure supplied is a result of the biasing spring 55 that urges the lever arm 51 in a direction tending to press the surface of the ink pad 47 against the transfer roll pad 65.

The transfer roll assembly 60, being positively driven through the gear train 70, 73, 75, 95, turns the ink roll assembly 40 as a result of the frictional engagement betwween the respective surfaces.

From the transfer roll pad 65 the ink is transferred to the typeface of the printing segment 90 as a result of the sliding contact between the ink-containing surface of the transfer roll pad and the typeface of the printing segment. As indicated below, there is a speed differential between these respective surfaces so as to provide a wiping effect, the speed differential preferably being between about 0.05% and 2% percent.

Accordingly the entire device is actuated by the drive rim 88 of the printing roll assembly 80 so that as the marking proceeds, simultaneous transfer of ink from the ink roll 47 occurs.

The approach of a particular carton 11 is sensed by the index roller 101. Once the initial movement of the index roller is completed, the drive rim 88 engages the surface of the respective carton 11, which causes rotation of the printing segment 90 and thus the application of the desired indicia on the surface of the carton.

After the printing roll assembly 80 completes about 1300° of turn, the index roller 101 again engages the carton 11 and prevents further turning of the printing roll assembly by disengaging the drive rim 88 from the surface of the carton. In this position, the cam roller 108 carried by the index housing 104 has been carried through rotation of the housing with the printing roll assembly 80 to a position radially offset from the initial position described.

This position will be held until the trailing end of the carton passes and causes freeing of the index roller 101. At this point the helical spring 111 causes the roller 101 to move toward a position tending to permit greater flexure of the cam lever arm 107 and thus rotate the printing roll assembly 80 back to the initial position where the roller 101 engages the detent portion of the eccentric cam 115.

As a result of the mechanism thus described, a sharp clear mark is applied to the surface of the cartons with sufficient accuracy and sharpness to permit optical scanners to correctly read the indicia. Sequential printing operations will thus continue until such a time as the supply of ink in the ink canister has been depleted. When this occurs, a new ink canister 47 need merely be placed on the hub 42 and the marking operations continued.

Figure 7:
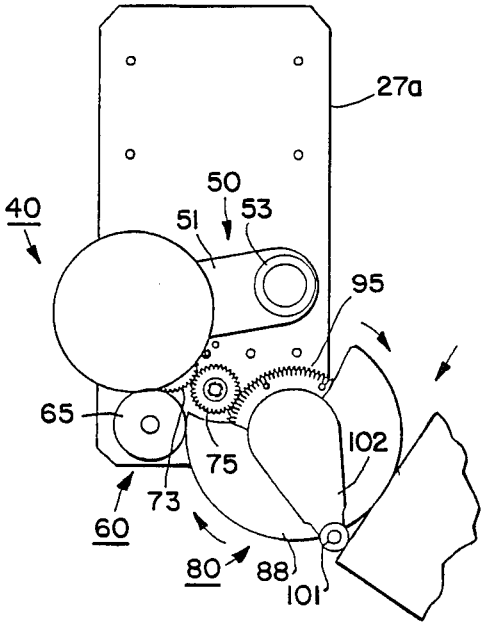
FIG. 7 is a plan view showing the printing apparatus arranged on the mounting plate to provide a right hand mount, print-early configuration.
Figure 8:
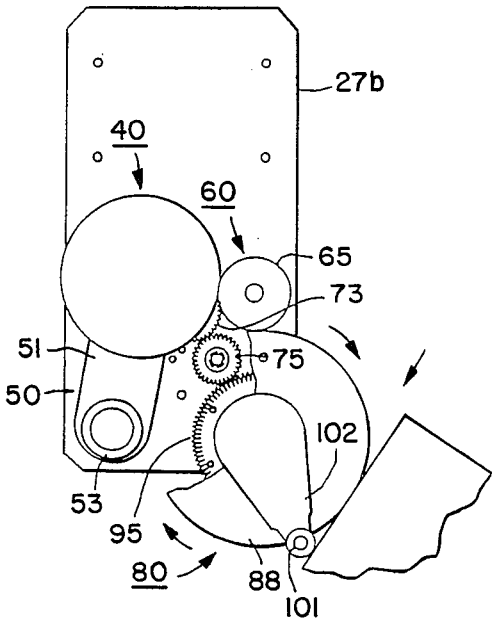
FIG. 8 is a plan view showing the printing apparatus arranged on the mounting plate to provide a right hand mount, print-late configuration.
Figure 9:
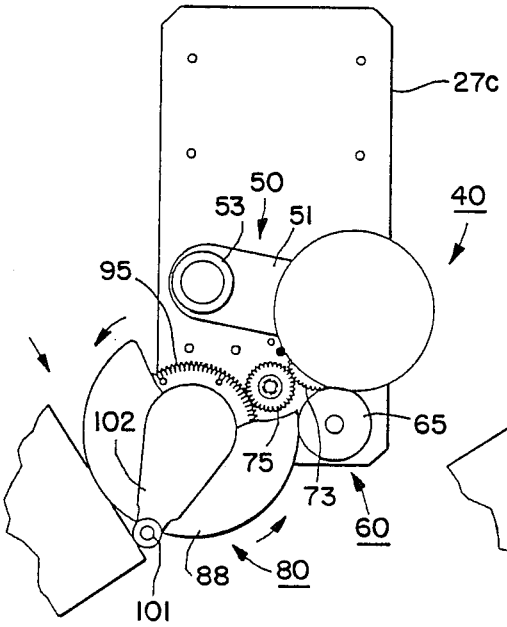
FIG. 9 is a plan view showing the printing apparatus arranged on the mounting plate to provide a left hand mount, print-early configuration.
Figure 10:
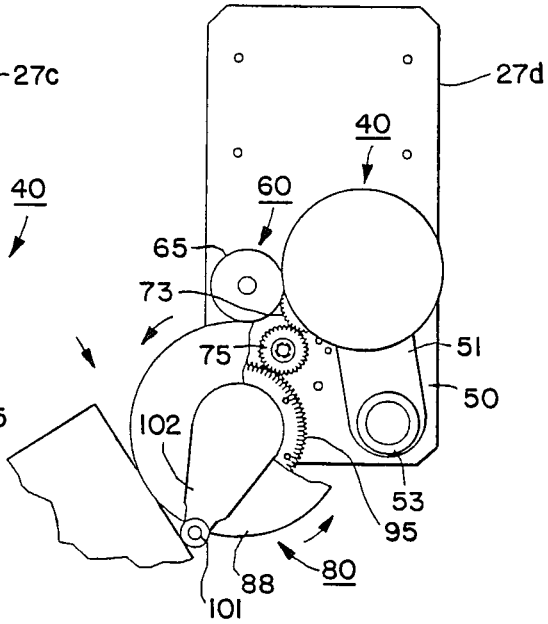
FIG. 10 is a plan view showing the printing apparatus arranged on the mounting plate to provide a left hand mount, print-late configuration.

FIGS. 7, 8, 9, and 10 illustrate four alternative positioning arrangements for the ink supply roll assembly 40, the transfer roll assembly 60, and the printing roll assembly 80. FIGS. 7 and 8 show arrangements wherein the printing is to be applied to the right-hand side of the boxes or cartons as viewed along the direction of travel, and FIGS. 9 and 10 illustrate two arrangements when the printing is to be applied to the left-hand side of the boxes or cartons 11 when viewed along the direction of travel.

In FIG. 7, the printing roll assembly 80 is mounted on the right-hand corner of a mounting plate **27*a* and the transfer roll assembly 60 is located so as to apply ink to the printing segment 90 when the segment is positioned on the roll to provide a "print-early" function or, in other words, to come into engagement closely adjacent the leading edge of the box or carton 11** to be marked.

FIG. 8 shows the ink transfer roll positioned on a mounting plate **27*b* to apply ink under conditions where the printing segment 90 is located to provide a "print-late" function or, in other words, to delay its printing until a substantial surface portion of the carton or box has proceeded past the printing roll assembly 80**.

Referring to FIGS. 9 and 10, in FIG. 9, the ink transfer roll is positioned on a mounting plate 27*c* to provide a "print-early" function, and in FIG. 10, the transfer roll is positioned on a mounting plate 27*d* to provide a "print-late" function.

Accordingly, by selecting among the four mounting plates 27*a*, 27*b*, 27*c*, and 27*d*, the invention can be adapted to different situations and different printing requirements merely by selecting the proper base plate.

While the invention has been shown and described with respect to a specific embodiment thereof, this is intended for the purpose of illustration rather than limitation, and other modifications and variations of the specific embodiment herein shown and described will be apparent to those skilled in the art all within the intended spirit and scope of the invention. Accordingly the patent is not to be limited in scope and effect to the specific embodiment herein shown and described nor in any other way that is inconsistent with the extent to which the progress in the art has been advanced by the invention.

What is claimed is:

1. A marking apparatus for printing indicia on a surface of products being transported along a predetermined path relative to the apparatus comprising:

a mounting base lacated adjacent said predetermined path;

a printing roll journaled on said base and having a drive rim adapted for rolling engagement with said surface to turn said printing roll, and a cylindrical marking surface adapted for rolling engagement with said surface to print indicia thereon;

a lever arm mounted at one end on said base for pivotal movement thereon about an axis;

means operative between said lever arm and said base for urging said lever arm with a predetermined force in one direction of rotation toward an operating position;

an ink supply roll journaled on the other end of said lever arm and having a porous ink-containing cylindrical surface;

an ink tranfer roll journaled on said base and having a cylindrical ink transfer surface adapted for engagement with said ink supply roll surface and said marking surface to tranfer ink from said supply roll to said printing roll; and gear means operatively connected between said printing roll and said transfer roll for turning said ink transfer surface at a surface speed differential of between 5% and 12% relative to the surface speed of said marking surface to provide sliding contact between said ink transfer surface and said marking surface.

2. A marking apparatus as defined in claim 1, wherein said urging means is effective to apply a force between said surface of said ink supply roll and said surface of said ink transfer roll of between about 0.75 and 1.5 lbs. per linear inch of contact.

3. A marking apparatus as defined in claim 2, wherein said urging means is effective to apply a force between said surface of said ink supply roll and said surface of said ink transfer roll of between about 0.9 and 1.1 lbs. per linear inch of contact.

4. A marking apparatus as defined in claim 1, wherein said surface speed differential between said surface of said ink transfer roll and said marking surface of said printing roll is about 7.5%.

5. A marking apparatus as defined in claim 1, wherein said urging means comprises a stationary element secured to said mounting base and a biasing element carried by said lever arm and adapted to bear between said lever arm and said stationary element to urge said ink supply roll against said ink transfer roll.

6. A marking apparatus as defined in claim 5, including threaded means for adjusting the amount of biasing force of said biasing element between said stationary element and said lever arm.

7. A marking apparatus as defined in claim 1, wherein said gear means comprises a drive pinion coaxially secured to said printing roll, a first idler gear drivingly engaging said drive pinion, a second idler gear drivingly engaging said first idler gear and a driven pinion coaxially secured to said ink transfer roll and drivingly engaged by said second idler gear.

8. A marking apparatus for printing indicia on a surface of products being transported along a predetermined path relative to the apparatus comprising:

a mounting base located adjacent said predetermined path;

a printing roll journaled on said base and having a drive rim adapted for rolling engagement with said surfaces to turn said printing roll, and a cylindrical marking surface adapted for rolling engagement with said surface to print indicia thereon;

a lever arm mounted at one end on said base for pivotal movement thereon about an axis;

a biasing element operative between said lever arm and said base for urging said lever arm with a predetermined force in one direction of rotation toward an operating position;

an ink supply roll journaled on the other end of said lever arm and having a porous ink-containing cylindrical surface;

an ink transfer roll journaled on said base and having a cylindrical ink transfer surface adapted for engagement with said ink supply roll surface and said marking surface to transfer ink from said supply roll to said printing roll, said biasing element being effective to apply a force between said surface of said ink supply roll and said surface of said ink transfer roll of between about 0.75 and 1.5 lbs. per linear inch of contact.

gear means operatively connected between said printing roll and said transfer roll for turning said ink transfer surface at a surface speed differential relative to the surface speed of said marking surface to provide sliding contact between said ink transfer surface and said marking surface.

9. A marking apparatus as defined in claim 8, wherein said urging means is effective to apply a force between said surface of said ink supply roll and said surface of said ink transfer roll of between about 0.9 and 1.1 lbs. per linear inch of contact.

10. A marking apparatus as defined in claim 8, wherein said urging means comprises a stationary element secured to said mounting base and wherein said biasing element is carried by said lever arm.

11. A marking apparatus as defined in claim 10, including threaded means for adjusting the amount of biasing force of said biasing element between said stationary element and said lever arm.

12. A marking apparatus as defined in claim 8, wherein said gear means comprises a drive pinion coaxially secured to said printing roll, a first idler gear drivingly engaging said drive pinion, a second idler gear drivingly engaging said first idler gear and a driven pinion coaxially secured to said ink transfer roll and drivingly engaged by said second idler gear.

* * * * *